US008543044B2

(12) United States Patent
Wazumi et al.

(10) Patent No.: US 8,543,044 B2
(45) Date of Patent: Sep. 24, 2013

(54) FIXING DEVICE AND IMAGE FORMING APPARATUS HAVING SHEET SEPARATION DEVICE

(75) Inventors: Toshihiro Wazumi, Hino (JP); Jinju Okuno, Hino (JP); Koji Yamamoto, Toyokawa (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 267 days.

(21) Appl. No.: 13/070,223

(22) Filed: Mar. 23, 2011

(65) Prior Publication Data

US 2011/0243619 A1 Oct. 6, 2011

(30) Foreign Application Priority Data

Mar. 30, 2010 (JP) ..... 2010-077218

(51) Int. Cl.
*G03G 15/20* (2006.01)

(52) U.S. Cl.
USPC ..... 399/323

(58) Field of Classification Search
USPC ..... 399/323, 398, 405; 271/309, 900
See application file for complete search history.

(56) References Cited

U.S. PATENT DOCUMENTS

| | | | | |
|---|---|---|---|---|
| 4,420,152 | A * | 12/1983 | Miyashita | 271/309 |
| 7,062,211 | B2 * | 6/2006 | Baba et al. | 399/323 |
| 2007/0217841 | A1 * | 9/2007 | Fujii | 399/341 |
| 2007/0231032 | A1 * | 10/2007 | Matsuno | 399/388 |
| 2011/0222921 | A1 * | 9/2011 | Murakami et al. | 399/323 |

FOREIGN PATENT DOCUMENTS

| | | | |
|---|---|---|---|
| JP | 2002311740 | A * | 10/2002 |
| JP | 2004205748 | A * | 7/2004 |
| JP | 2004205750 | A * | 7/2004 |
| JP | 2004205751 | A * | 7/2004 |
| JP | 2005-202043 | | 7/2005 |

* cited by examiner

*Primary Examiner* — Robert Beatty
(74) *Attorney, Agent, or Firm* — Finnegan, Henderson, Farabow, Garrett & Dunner, L.L.P.

(57) ABSTRACT

A fixing device conveying a sheet carrying a toner image under heating and pressurization at a nip section and fixing the toner image on the sheet comprising; a fixing member provided with a heating member, a pressure member pressing on the fixing member and forming the nip section which sandwiches the sheet carrying the toner image; a blower duct equipped with an outlet opening toward a vicinity of a sheet outlet of the nip section; a blower member for blowing air in a vicinity of the sheet outlet through the blower duct; and a guide device provided with a guide member for guiding the sheet ejected from the nip section arranged on an upper side of a sheet conveyance path; and, further comprising a biasing member for biasing the sheet toward the guide member, in the vicinity of the nip section.

7 Claims, 14 Drawing Sheets

FIXING DEVICE AND IMAGE FORMING APPARATUS HAVING SHEET SEPARATION DEVICE

RELATED APPLICATION

The present application is based on Patent Application No. 2010-077218 filed at the Japan Patent Office on Mar. 30, 2010 and which is hereby incorporated herein in its entirety.

TECHNICAL FIELD

The present invention relates to a fixing device for fixing a toner image on a sheet of paper by a nip section made up of a fixing member and pressure member, and an image forming apparatus equipped with this fixing device.

BACKGROUND

In the image forming apparatus using electrophotographic process such as a photocopier, printer, facsimile and multi-functional peripheral provided with the functions thereof; a latent image corresponding to a manuscript is formed on a photoreceptor, and toner is applied to this latent image, which is thereby developed. This developed toner image is transferred onto the sheet of paper. After that, the toner image transferred on the sheet is fixed in position and is then ejected.

One of the aforementioned fixing devices for fixing the toner image is a fixing device using a heated roller fixing method, wherein the sheet with the toner image transferred thereon is sandwiched and conveyed by the nip section formed of a fixing roller (fixing member) incorporating a halogen heater and others as a heating means, and a pressure roller (pressure member) for applying pressure to the fixing roller. The sheet is heated and pressed while it is conveyed. This fixing device is used over an extensive range because of simple configuration.

Another of the aforementioned fixing devices for fixing the toner image is a fixing device using a belt fixing method, wherein the endless fixing belt (fixing member) is applied to a heating roller incorporating a halogen heater and others, and a fixing roller; and a pressure roller for applying pressure to the fixing roller through a fixing belt is provided. While the sheet with a toner image transferred thereon is sandwiched and conveyed by the nip section formed of a fixing belt and pressure roller, the sheet is heated and pressed during this time. Such a fixing device has a small heat capacity of the fixing belt This reduces the warming up time, and provides an advantage of energy conservation.

In this case, the toner of the toner image of the sheet is heated while the sheet is passed through the nip section. Since the toner has an adhesive strength, the sheet passing through the nip section may stick to the surface of the fixing roller and fixing belt, and may wind the roller without being separated, with the result that a paper jam may occur. The separability will be reduced especially when the coated sheet of a smaller basis weight for printing (thin paper) is used.

In the meantime, if the fixing roller size is increased in order to ensure the sufficient nip width to cope with an increasing speed of the image forming apparatus, the roller curvature at the outlet of the fixing nip will be reduced, with the result that the separation performance will be reduced.

A separation member is used to cope with the reduction in the separation performance. This means uses a blower means and blower duct to blow air to the outlet side of the nip section for the purpose of separating sheets from the fixing member.

An example of using such a separation member is found in a fixing device having been disclosed. This means is provided with a gas discharge means made up of a separation guide plate whose one side approaches the surface of the fixing member and which is arranged lying in the circumferentially moving direction of the fixing member, and a plurality of nozzles for discharging pulse-like compressed air from the area sandwiched in-between the fixing member and the surface of the separation guide plate facing the same, toward the gap between the fixing member and one side of the separation guide plate approaching the same, a plurality of the aforementioned nozzles being arranged perpendicular to the circumferentially moving direction of the fixing member (refer to Unexamined Japanese Patent Application Publication No. 2005-202043).

Unexamined Japanese Patent Application Publication No. 2005-202043 uses the discharge of compressed air by the gas discharge means to separate the leading edge of the sheet, and uses a separation guide plate to separate the subsequent portion up to the trailing edge.

However, the separation failure of the sheet having passed through the nip section and winding of the sheet on the surface of the fixing member such as a fixing roller or fixing belt occur not only to the leading edge of the sheet, but also to the portion subsequent to the leading edge. Further, even when the leading edge of the sheet is pulled out by the sheet ejection roller, uneven separation remains on the wound portion. Thus, when air is to be blown to the outlet side of the nip section to separate the sheet from the fixing roller and others, air is preferably blown on a continuous basis.

However, after having separated the sheet from the fixing belt or fixing roller, the continuously blown air is repelled from the nip section to create a turbulent flow such as an eddy. The turbulent flow may cause the sheet to flap and may disturb conveyance of sheets. Particularly the thin sheet of smaller rigidity and smaller basis weight is subjected to such a turbulent flow, with the result that a conveyance trouble such as a jam may be caused. This adverse effect will be increased if the air flow is increased to improve the separation performance.

In view of the problems described above, it is an object of the present invention to provide a fixing device capable of minimizing flapping of the sheet caused by the air blown to separate the sheet from a fixing member and ensuring the stable sheet conveyance thereby.

SUMMARY

The aforementioned object of the present invention can be achieved by the following Structures:

1. To achieve at least one of the abovementioned objects, a fixing device conveying a sheet carrying a toner image under heating and pressurization at a nip section and fixing the toner image on the sheet reflecting one aspect of the present invention comprises a fixing member provided with a heating member; a pressure member pressing on the fixing member and forming the nip section which sandwiches the sheet carrying the toner image; a blower duct equipped with an outlet opening toward a vicinity of a sheet outlet of the nip section; a blower member for blowing air in a vicinity of the sheet outlet through the blower duct; and a guide device provided with a guide member for guiding the sheet ejected from the nip section arranged on an upper side of a sheet conveyance path; and, further comprising a biasing member for biasing the sheet toward the guide member, in the vicinity of the nip section.
2. In the abovementioned fixing device of item1, wherein the biasing member biases the sheet toward the guide member, using an exhaust gas flow moving along an exhaust gas flow path formed through the guide device between the blower duct and the sheet.

3. In the abovementioned fixing device of item2, wherein a sectional area of the exhaust gas flow path is increased in size in a direction in which the exhaust gas flow moves.
4. In the abovementioned fixing device of item1, wherein the guide device is configured to comprise a rib.
5. In the abovementioned fixing device of item1, wherein the guide device is configured to comprise a net.
6. In the abovementioned fixing device of item1, wherein the guide device is configured to comprise a belt.
7. In the abovementioned fixing device of item1, wherein at least a portion of the guide device facing the sheet travels at a speed higher than a conveying speed of the sheet.
8. In the abovementioned fixing device of item1 further comprising; a separation claw arranged on a lower side of the sheet conveyance path to separate the sheet from the pressure member.
9. An image forming apparatus comprises the abovementioned fixing device of item 1.

Effects of the Invention

The above description shows that the flapping of the sheets can be minimized. Accordingly, the deformation of sheet and occurrence of paper jam can be avoided, and stable conveyance of the sheet is ensured, without a faulty image being formed.

DESCRIPTION OF THE PREFERRED EMBODIMENTS

The following describes the embodiments of the present invention with reference to figures, without the present invention being restricted thereto.

Figure 1:
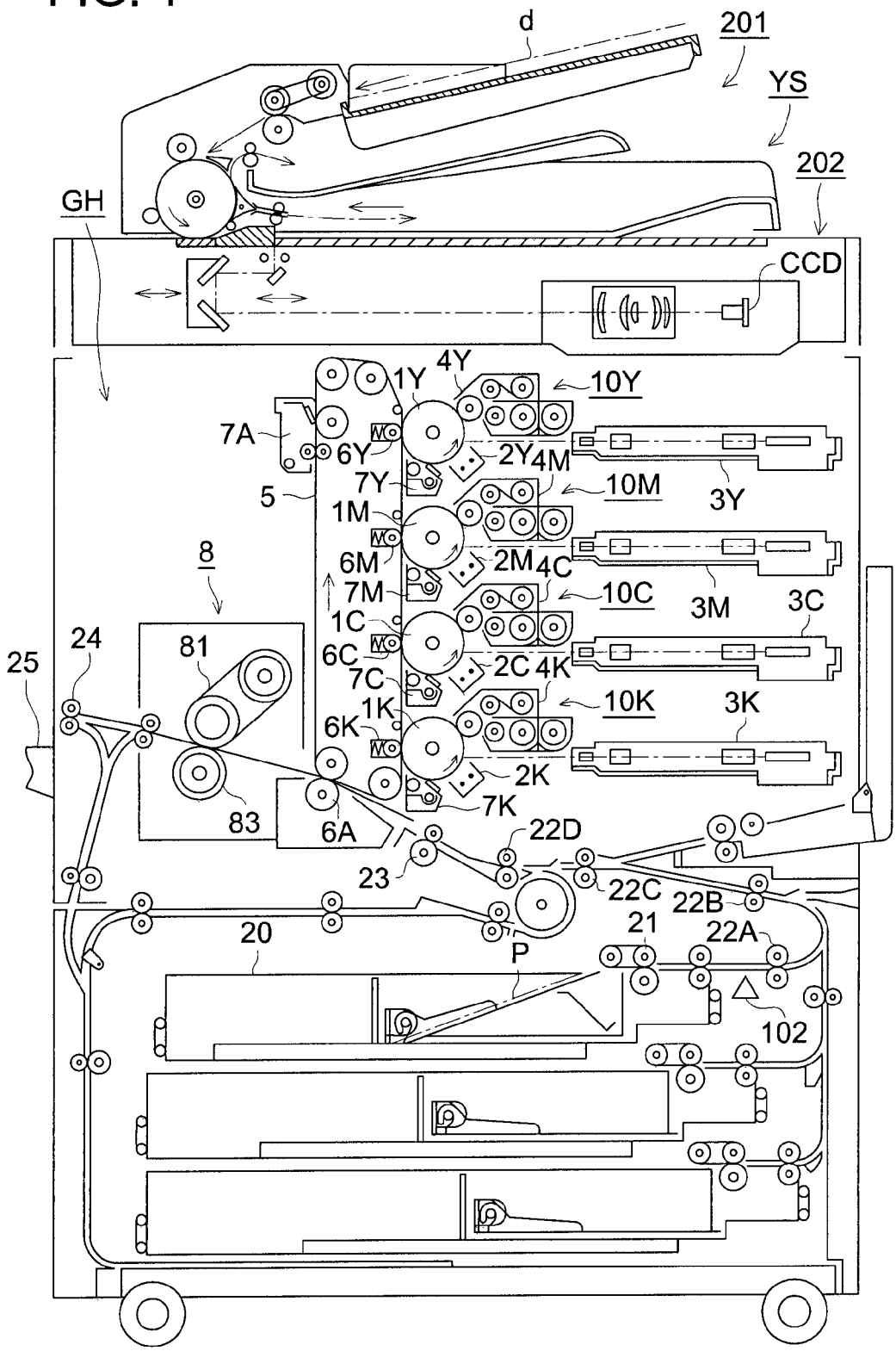
FIG. 1 is a diagram representing an example of the image forming apparatus in the present invention.

In the first place, the following describes an example of the image forming apparatus in the present invention with reference to the configuration diagram of FIG. 1:

The present image forming apparatus is made up of an image forming apparatus body GH and an image reading device YS. The image forming apparatus body GH is what is commonly called the tandem type color image forming apparatus, and includes a plurality of sets of image forming sections 10Y, 10M, 10C and 10K, belt-shaped intermediate transfer belt 5, sheet feed and conveying means and fixing device 8, and others.

An automatic document feeder 201, and an image reading device YS made up of a document image scanning/exposure device 202 are mounted on the upper part of the image forming apparatus body GH. The document d placed on the document platen of the automatic document feeder 201 is conveyed by the conveying means. The image on side or both sides of the document is scanned and exposed by the optical system of the document image scanning/exposure device 202, and is read into the line image sensor CCD.

The signal formed by photoelectric conversion by means of a line image sensor CCD is subjected to analog processing, analog-to-digital conversion, shading correction, image compression and other processing in the image processing section, and is then sent to the exposure means 3Y, 3M, 3C and 3K.

The image forming section 10Y for forming a yellow (Y) image includes a charging means 2Y, exposure means 3Y, development means 4Y and cleaning means 7Y arranged around the photoreceptor drum 1Y. The image forming section 10M for forming a magenta (M) image has a charging means 2M, exposure means 3M, development means 4M and cleaning means 7M arranged around the photoreceptor drum 1M. The image forming section 10C for forming a cyan (C) image has a charging means 2C, exposure means 3C, development means 4C and cleaning means 7C arranged around the photoreceptor drum 1C. The image forming section 10K for forming the black (K) image has a charging means 2K, exposure means 3K, development means 4K and cleaning means 7K arranged around the photoreceptor drum 1K. The latent image forming means is formed by the charging means 2Y, exposure means 3Y, charging means 2M, exposure device 3M, charging means 2C, exposure means 3C, charging means 2K and exposure means 3K.

The development units 4Y, 4M, 4C and 4K includes a two-component developer made of small-diameter toner particles and carriers of yellow (Y), magenta (M), cyan (C) and black (K) colors. The toner is formed of a pigment or dye as a coloring reagent, and a wax that assists separation of the toner from a fixing member subsequent to fixing, as well as the binder resin combining these two substances.

The intermediate transfer belt 5 is applied around a plurality of rollers, and is rotatably supported.

The fixing device 8 fixes the toner image in position in the process wherein the toner image of the sheet P is heated and pressed by a nip section formed between the fixing belt 81 as a heated fixing member and a pressure roller 83 as a pressure member.

Thus, the multi-colored image formed by the image forming sections 10Y, 10M, 10C and 10K is sequentially transferred onto the rotating intermediate transfer belt 5 by the transfer units 6Y, 6M, 6C and 6K (primary transfer), and a toner image made by superimposition of color images is produced. The sheet P incorporated in a sheet feed cassette 20 is fed by the sheet feed means 21 is conveyed to the transfer means 6A through the sheet feed rollers 22A, 22B, 22C and 22D, and the registration roller 23 and others, and a color image is transferred onto the sheet P (secondary transfer). The sheet P with the color image having been transferred thereto is heated and pressed by the fixing device 8, whereby the color toner image of the sheet P is fixed in position. After that, the sheet is sandwiched by the sheet ejection rollers 24 and is placed on the sheet ejection tray 25 outside the apparatus.

In the meantime, the color image is transfer onto the sheet P by the transfer means 6A. After that, residual toner is removed by a cleaning means 7A from the intermediate transfer belt 5 by which the sheet P has been curvature-separated.

The aforementioned description has referred to an image forming apparatus for forming a color image. However, it can be an image forming apparatus for forming a monochromatic image. Further, use of the intermediate transfer belt is not essential.

Further, the fixing device 8 can be designed in a heating roller fixing type configuration wherein the fixing member uses a roller equipped with a heating member.

Figure 2:
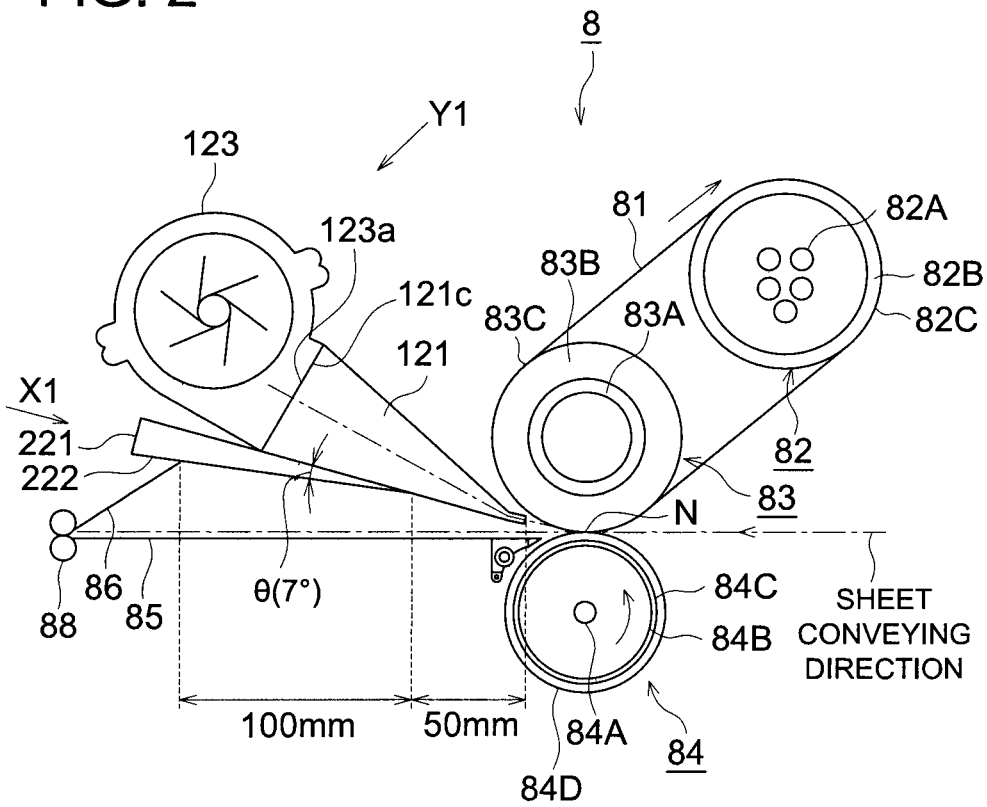
FIG. 2 is a cross sectional view representing an example of the fixing device in the present invention.

Referring to drawings, the following describes the fixing device 8 of the present invention:

FIG. 2 is a cross sectional view representing an example of the fixing device (belt fixing device) in the present invention, and shows the configuration of the Example 1 to be described later. The following description uses an example wherein image forming operation is applied to one hundred A4-sized sheets P per minute.

The fixing belt 81 (fixing member) is formed in an endless shape. For example, PI (polyimide) having a thickness of 70 μm is used as a substrate, and the outer peripheral surface of the substrate as an elastic layer is coated with a heat resistant silicone rubber (hardness JIS-A30°) having a thickness of 200 μm Further, the heat-resistant resin having a thickness of 30 μm is coated with PFA (tetrafluoro alkoxy). The external diameter is 168 mm, for example.

The heating roller 82 incorporates a halogen heater 82A as a heating member for heating the fixing belt 81. For example, the outer peripheral surface of the aluminum-made cylindrical cored bar 82B having a wall thickness of 4 mm is covered with the resin layer 82C coated with 30 μm thick PTFE. The external diameter is 90 mm, for example. It should be noted that, to cope with different paper widths, the halogen heaters 82A include, for example, two 1200-watt heaters, two 750-watt heaters and one 500-watt heaters. These heaters are arranged to provide distribution of heat generations different in the direction of shaft in order to meet different widths of sheets.

The fixing roller 83 is coated with a resin layer 83C wherein the solid cored bar 83A formed of such a metal as iron is covered with a 20 mm-thick heat resistant silicone rubber (hardness JIS-A5°) as an elastic layer 83B and is further coated with the 30 μm-thick PTFE heat-resistant resin of low friction. The outer diameter is 90 mm, for example.

The pressure roller 84 (pressure member) incorporates a halogen heater 84A to reduce the temperature rise time immediately after turning on power for the image output device. The outer peripheral surface of the 4 mm-thick cylindrical cored bar 84B formed of aluminum or the like is covered with a 1 mm-thick heat resistant silicone rubber (hardness JIS-A30°) as an elastic layer 84C, and is further coated with the resin layer 84D of 30 μm thick PFA tube. The outer diameter is 90 mm. The halogen heater 84A is a 700 watt heater, for example.

A pressure means (not illustrated) allows the pressure roller 84 to press the fixing roller 83 through the fixing belt 81.

In the aforementioned configuration, when the pressure roller 84 is rotated in the counterclockwise direction by the drive means (not illustrated), the fixing belt 81 and heating roller 82 rotates in the clockwise direction, and the fixing roller 83 also rotates in the clockwise direction. The fixing roller 83 can be driven. The fixing belt 81 is heated by the halogen heater 82A through the abutting heating roller 82, and the pressure roller 84 is also heated by the halogen heater 84A. Since the pressure roller 84 is pressed in the direction of the fixing roller 83 by the pressure means, the sheet P having been fed is heated and pressed in the nip section N formed between the fixing belt 81 wound on the fixing roller 83 and the pressure roller 84, whereby the toner image is fixed on the sheet P.

The following describes the examples of fixing conditions:

Fixing load: 2500 N

Fixing belt tension: 250 N

Fixing belt control temperature: 160 through 200 degrees Celsius

Pressure roller control temperature: 80 through 120 degrees Celsius

Sheet conveying speed: 500 mm/s

Any heating member can be used to heat the fixing belt 81. For example, it is possible to employ an inductive heating element using an exciting coil. Further, the position for installing the heating member is not restricted to a space within the heating roller 82.

It is also possible to provide a tension roller for providing the fixing belt 81 with tension, and an offset correction roller for controlling the meandering of the belt.

If the sheet P having been fixed in position by the aforementioned fixing device 8 is ejected from the nip section N, and sticks to the fixing belt 81 and winds the same thereafter, a paper jam may occur. This requires a positive means to be taken to separate the sheet P from the fixing belt 81.

The fixing device 8 of the embodiment of the present invention uses a pneumatically driven separation member wherein air is blown to the outlet side of the nip section N, and the sheet is separated from the fixing belt 81.

The following describes the pneumatically driven separation member.

Figure 3:
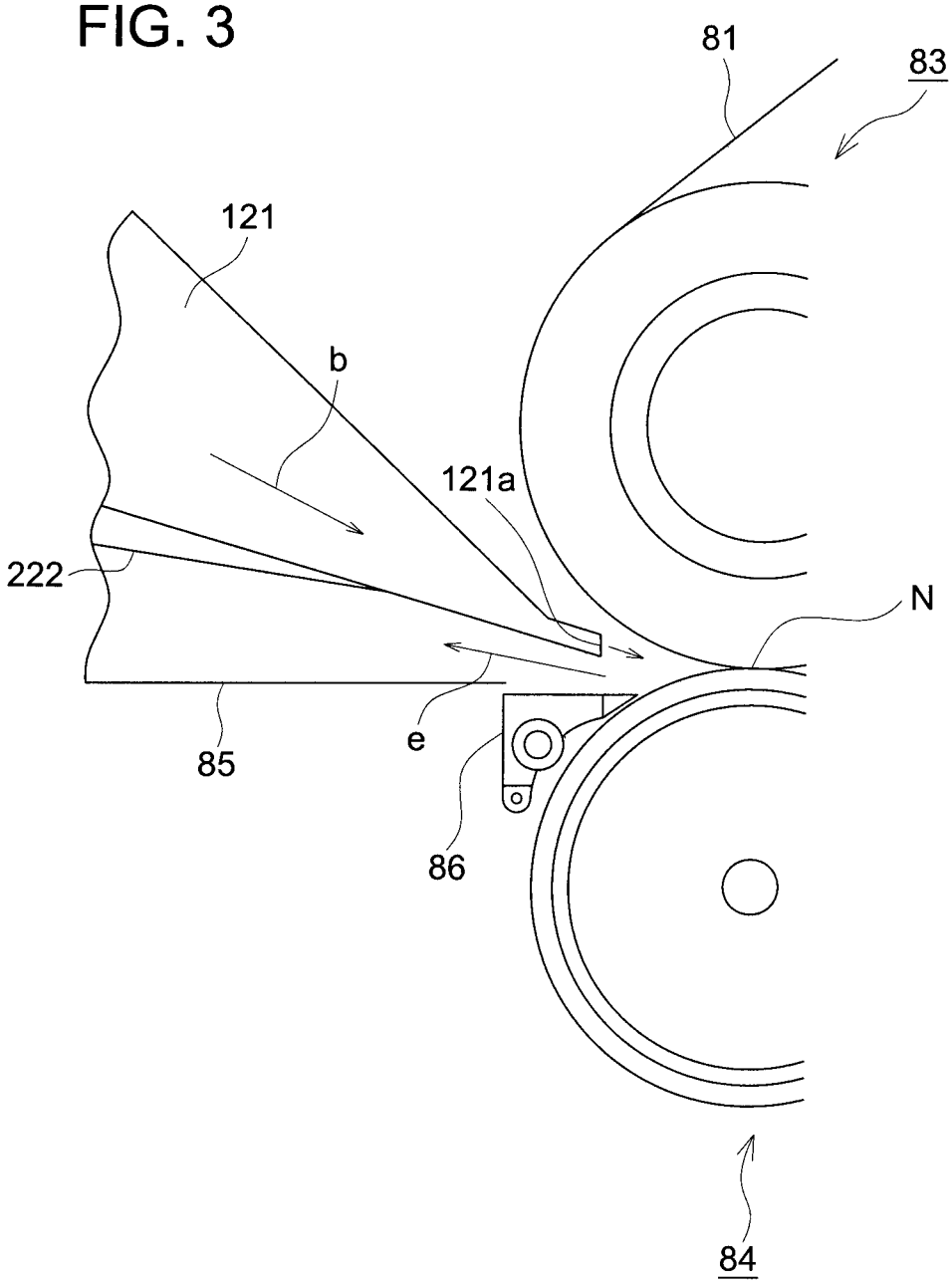
FIG. 3 is an enlarged view showing the vicinity of a sheet outlet of a nip section N in FIG. 2.

FIG. 3 is an enlarged view showing the vicinity of a sheet outlet of a nip section N in FIG. 2.

The blower duct 121 has an outlet 121*a* opening toward the vicinity of the sheet outlet side of the nip section N, and opening 121*c* connected to the outlet 123*a* of the fan 123 as a blower menber.

The blower duct 121 is arranged in such a way that the outlet 121*a* will be located at a distance of 25 mm from the nip section N outlet, and the extension of the blower duct 121 will be directed toward the outer peripheral surface of the fixing belt 81 located 10 mm from the nip section N outlet in the rotating direction, from the tangential direction.

The outlet 121*a* of the blower duct 121 and the opening 121*c* have a length of about 100 mm. The opening 121*c* and outlet 123*a* of the fan 123 are directly coupled.

The fan 123 discharges air from the outlet 121*a* toward the vicinity of the sheet outlet of the nip section N through the blower duct 121 on a continuous basis. The air is blown to the sheet P to separate the sheet P from the fixing belt 81. The arrow mark b of FIG. 3 indicates the flow of air to separate the sheet P. The arrow mark e indicates the flow of air after having separate the sheet P. Namely, it shows an exhaust gas flow.

A sirocco fan, for example, is preferably used as the fan 123 because of greater static pressure, without the fan 123 *b* being restricted thereto.

The fan 123 of this embodiment is a sirocco fan having an outer diameter of 97 mm and a width of 33 mm, with a power of 39 W and a static pressure of 1280 Pa.

In this embodiment, one blower duct 121 is connected to one fan 123 to form one set. Five sets thereof are arranged across the width of the sheet P (in the longitudinal direction of the nip section N). Namely, five outlets 121*a* of the blower ducts 121 are arranged continuously in a straight line.

Figure 4:
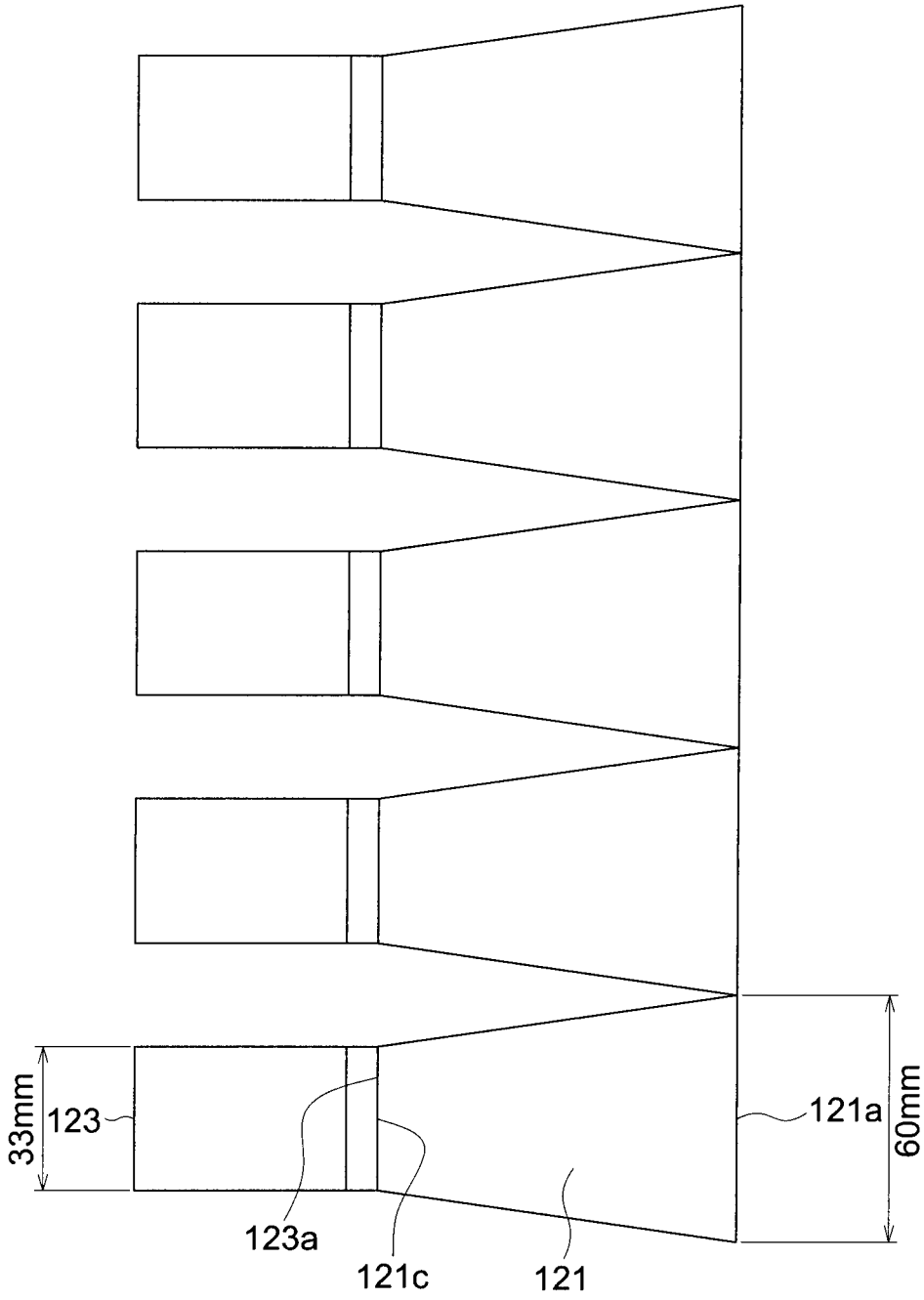
FIG. 4 is a diagram showing a layout example of a blower duct and a fan.

FIG. 4 is a top view showing a layout example of a blower duct 121 and a fan 123, as observed from the arrow mark Y1 of FIG. 2.

The outlet 121*a* has an opening which measures approximately 60 mm across the width of the sheet P and 1.6 mm along the thickness of the sheet (in the vertical direction of FIG. 2). Accordingly, five blower ducts 121 have an opening with a width of 300 mm and a height of 1.6 mm. The total volume of air discharged from the outlet 121*a* amounts to 0.016 $m^3/s$.

In the image forming operation, the sheet P is fed out from the registration roller 23 (FIG. 1). At the same time, power is applied to the fan 123 so that air is fed to assist separation of the sheet from the blower duct 121. In the vicinity of the N outlet, an air flow with a velocity of 30 m per second is formed from the image surface side to the non-image surface side.

The sheet P having been separated from the fixing belt 81 is conveyed while being held at the side of the pressure roller 84 by the air flow, and is separated from the pressure roller 84 by the separation claw 86 having a tip end width of 12 m arranged in contact with the pressure roller 84 under a load of about 10 mN. The separation claw 86 is formed of a heat resistant resin with its surface coated with fluorine resin. The abutting load of the separation claw 86 depends on the relationship between the width and material of the claw, and the material of the surface of the pressure roller 84. The abutting load is set without allowing the pressure roller 84 to be damaged.

The separation claw having been used in the conventional fixing device based on electrophotographic process can be employed as the separation claw 86. Further, approximately 3 through 8 separation claws 86 are installed at prescribed space intervals, with consideration given to the rigidity of the transfer material, and configuration of the fixing device.

The sheet ejection guide plate 85 is composed of a great number of ribs or smaller rollers arranged in parallel to the sheet conveying direction below the sheet conveyance path. This arrangement prevents the ejected sheet P from sticking to the sheet ejection guide plate 85, and avoids paper ejection failure. A pair of sheet ejection rollers 88 is provided on the downstream side in the conveying direction of the sheet ejection guide plate 85.

Since the pressure roller 84 is kept at such a temperature that the toner is not melted (90 through 110 degrees Celsius in this Example), the image is immune to any damage that may be caused by the separation claw 86, even if an image is located on the side of the pressure roller 84. To keep the pressure roller 84 at a low temperature, a distance between transfer and fixing positions in excess of the maximum length of the sheet is provided, and the sheet-to-sheet distance is reduced in the range from transfer and fixing positions, thereby reducing the amount of heat transfer from the fixing belt 81 to the pressure roller 84 or cooling the inner periphery and outer periphery of the roller by a fan.

Figure 20:
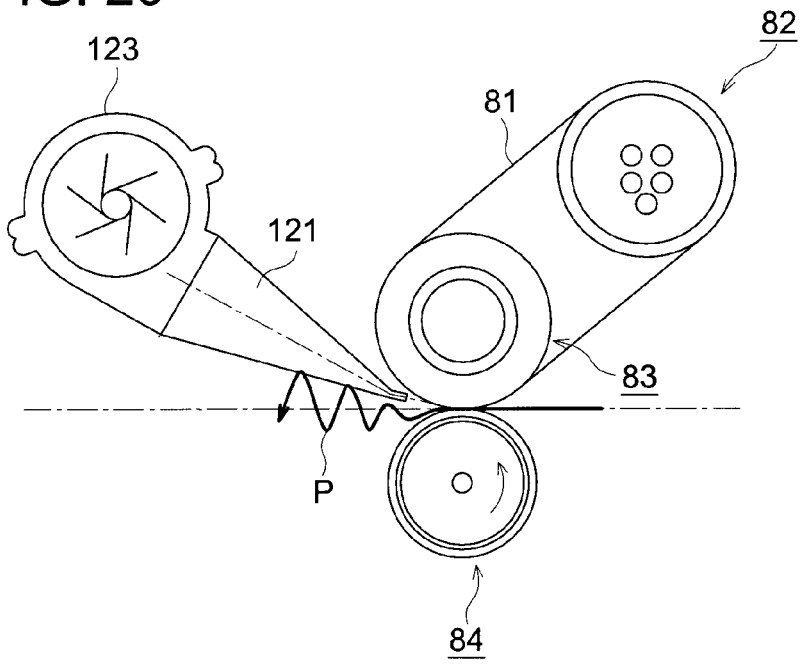
FIG. 20 is a schematic diagram showing an example of the sheet P flapping.

Incidentally, if air is blown by the fan 123 on a continuous basis, the blown air separates the sheet P from the fixing belt 81. After that, the air is repelled by the nip section N, whereby an eddy and a turbulent flow are created. This will cause the sheet P to flap and will disturb the conveyance of the sheet P. FIG. 20 is a schematic diagram showing an example of flapping. The flapping will cause a conveyance trouble such as a paper jam.

In the present invention, a guide device for guiding the sheet P and a biasing member for biasing the sheet P toward the guide device are provided. When the sheet P is biased toward the guide device by the biasing member, the flapping of the sheet P is reduced.

EXAMPLE 1

FIG. 2 shows Example 1, as described above.

The present inventors conducted a test (Test 1) to verify the flapping. The following describes the result of this test:

<<Test 1>>

FIGS. 5 through 8 shows the Test 1 conducted to verify the relationship between the free length of the sheet P (L1 of FIG. 5) and flapping. The free length of the sheet P in the sense in which it is used here refers to the distance from the tip end of the nipped sheet P in the sheet conveying direction to the outlet of the nip section N.

Figure 5:
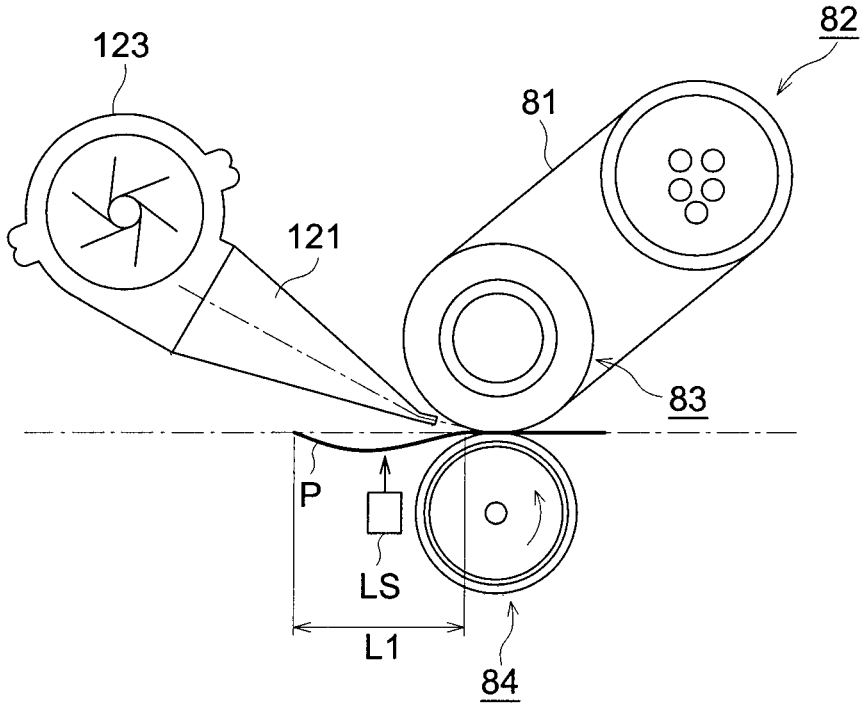
FIG. 5 is a diagram showing the configuration of the equipment used in Test 1.

FIG. 5 is a diagram showing the configuration of the equipment used in Test 1. The nip section N and blower duct 121 used in this test has the same configuration as that of Example 1. The wind velocity in the vicinity of the nip section N outlet is approximately 30 m per second.

When the fixing belt 81 was stopped, the sheet P was sandwiched and air was blown from the blower duct 121 so as to change the free length L1, whereby the occurrence of flapping was checked.

In the first place, a laser displacement meter (LB-01 by Keyence Corp.) LS was placed at a prescribed position on the downstream side of the nip section N in the sheet conveying direction, and the vibration of flapping of the sheet P was measured at a prescribed position. The amplitude of the sheet P was frequency-analyzed at the measured output (voltage (V)), using the FFT analyzer (CF6400 by Ono Sokki Co., Ltd.) (not illustrated) connected to the laser displacement meter.

Figure 6:
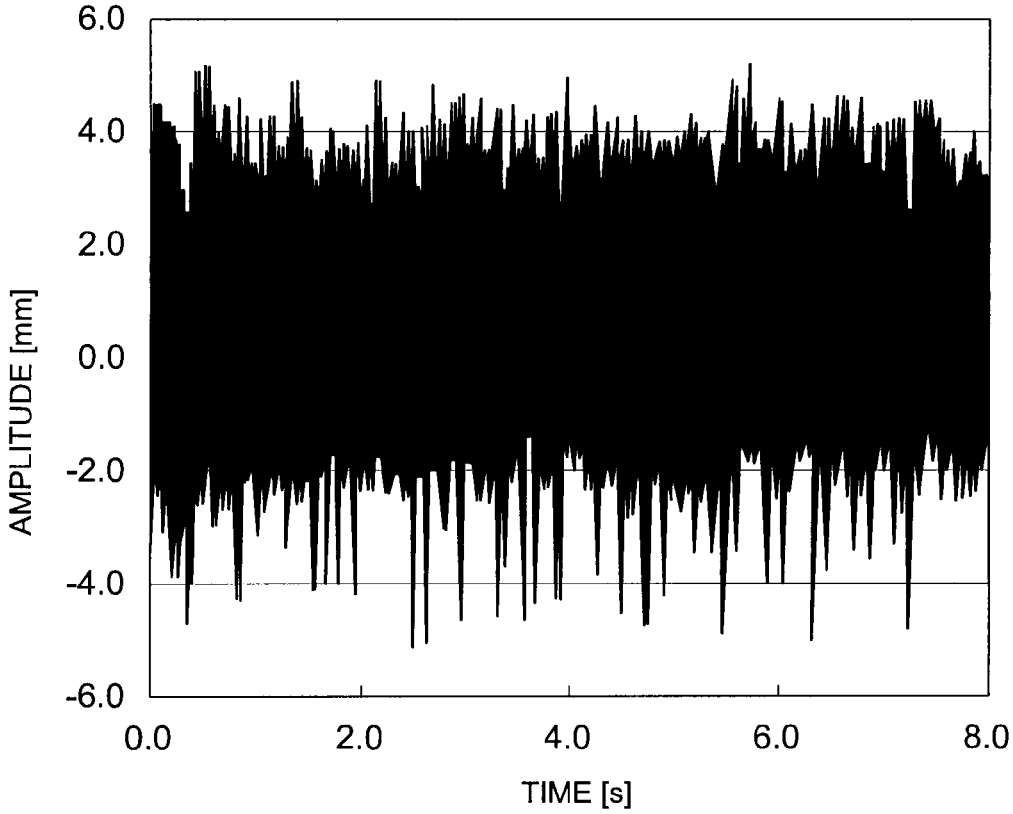
FIG. 6 is a diagram showing the data obtained by measuring the vibration in sheet flapping in Test 1.
Figure 7:
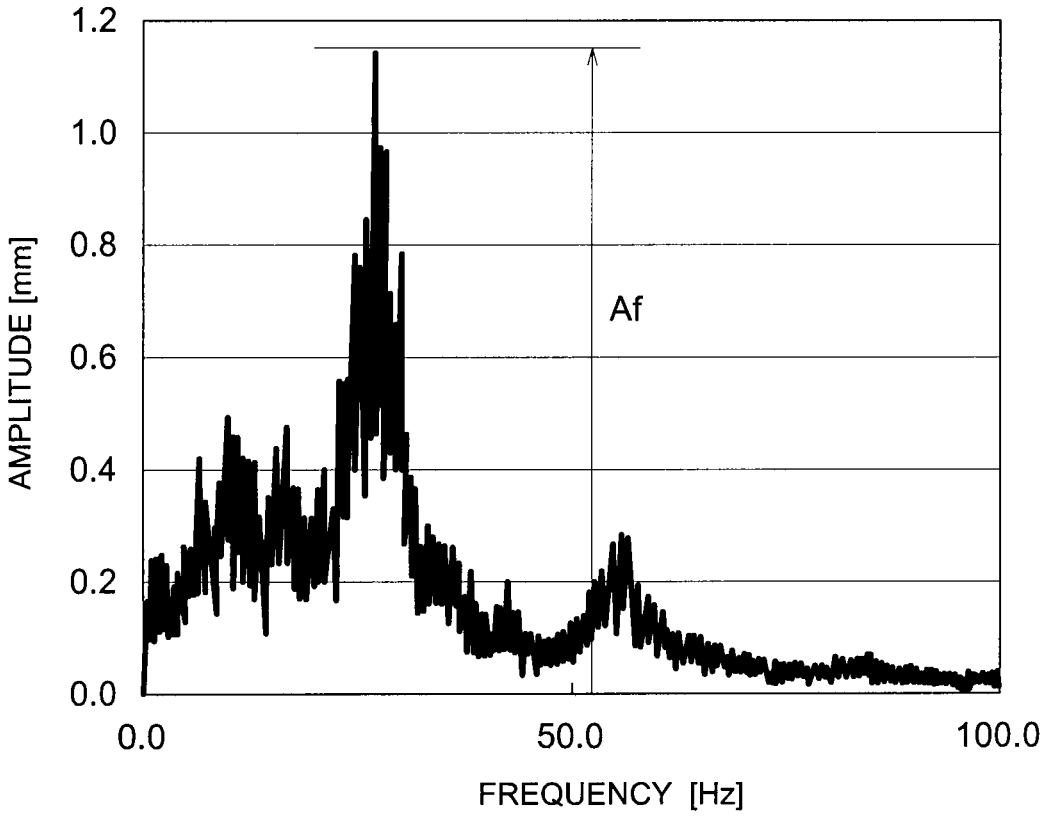
FIG. 7 is a diagram showing the result of the frequency analysis of the data obtained by measuring the vibration in sheet flapping.

FIG. 6 and FIG. 7 show how to analyze the flapping. Since the amplitude is formed of a superimposition of various forms of vibration modes, the data having been obtained (FIG. 6) is subjected to Fourier transformation, whereby amplitude Af in each frequency was calculated (FIG. 7). The calculated amplitudes at various frequencies are added in the range from 0 through 100 Hz, to get the amplitude overall value ΣA (0 through 100 Hz). This value is used to evaluate the flapping.

Figure 8:
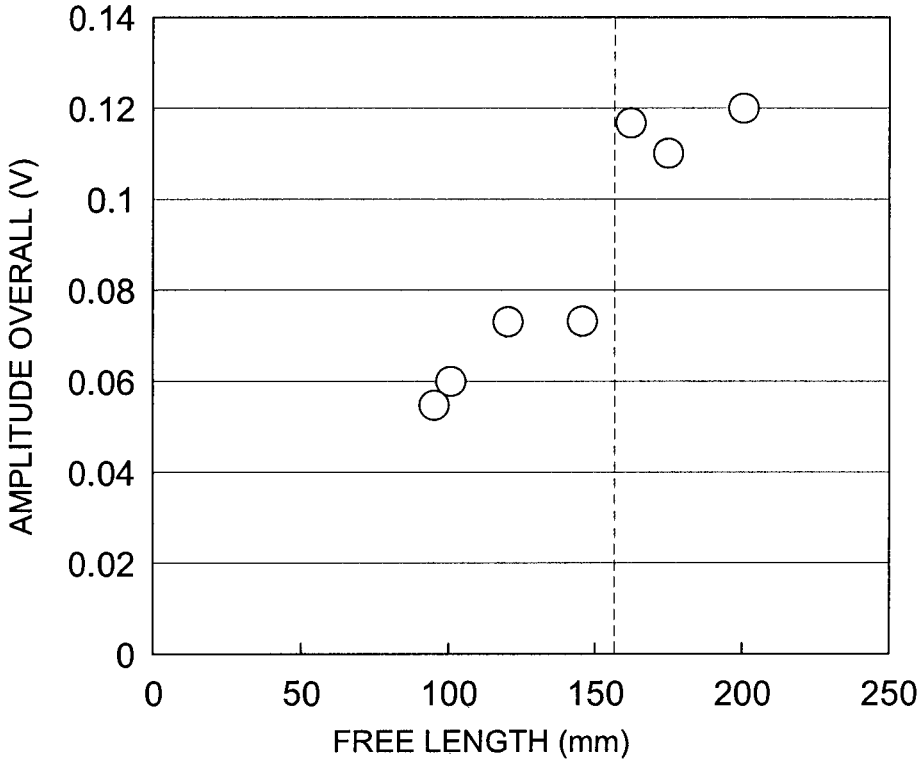
FIG. 8 is a diagram showing the result of Test 1.

FIG. 8 is a diagram showing the result of Test 1 (the relationship between the free length of sheet P and flapping). As the free length L1 increases, the amplitude overall value increases. In the configuration of the present Example, if the free length has exceeded 150 mm, i.e., if the free length increases over the broken line of FIG. 8, the flapping increases when the lower surface of the blower duct 121 is brought in contact.

The above study has demonstrated that controlling the flapping of the sheet P before the free length reaches 150 mm is an effective solution.

Based on the result of Test 1, an upper guide plate 221 as a guide device on the upper side of the sheet P along the conveyance path (on image surface side) is provided on the lower surface of the blower duct 121 (FIG. 2) in Example 1.

Figure 9:
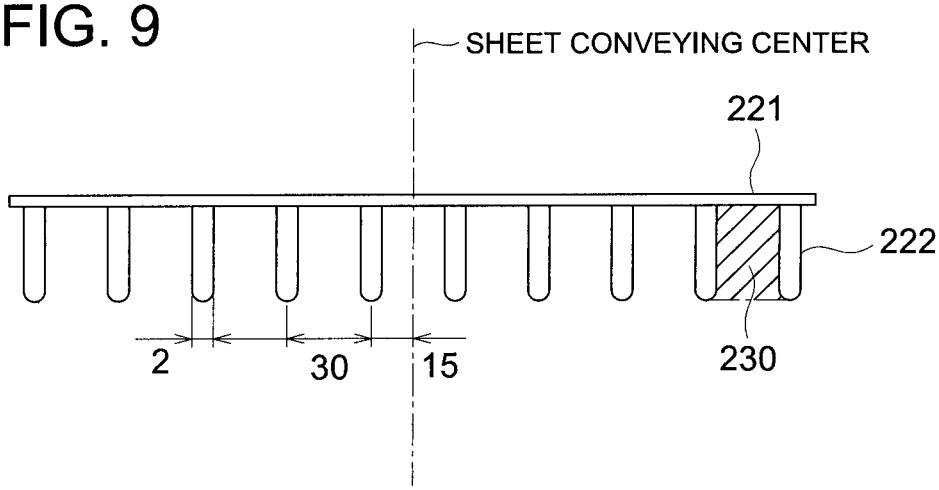
FIG. 9 is a front view of an upper guide plate 221 as viewed from the direction of arrow mark X1 in FIG. 2.

FIG. 9 is a front view of an upper guide plate 221 as viewed from the direction of arrow mark X1 in FIG. 2. The upper guide plate 221 has a plurality of ribs 222 as guide members on the side in contact with the sheet P.

As shown in FIG. 2, the ribs 222 are arranged in such a way as to expand at an angle of θ with reference to the upper guide plate 221 from the position of 50 mm, i.e., from the outlet 121*a* toward the downstream side of sheet conveyance, i.e., in the flow direction of the exhaust gas. The ribs 222 are configured to form a triangle with a length of 100 mm or more to ensure that the tip end of the sheet ejection guide 86 contacts the upper surface of the rib 222. Namely, ribs 222 are configured in such a way as to expand at an angle of θ from the lower surface of the blower duct 221. Thus, the upper guide plate 221 is configured to have grooves 230 which are each enclosed by two ribs 222, and which communicate with each other in the sheet P conveying direction. The sectional area of the groove 230 increases in the direction of exhaust gas flow.

Based on the specifications and configuration of the particular fixing device for each model, the angle θ is determined in the Test (Test 2 to be described later). As shown in FIG. 9, ten ribs 222 are uniformly arranged at intervals of 30 mm in the direction across the width of sheet P from the sheet conveyance center. Each rib has a width of 2 mm, and the tip end thereof is provided with roundness R1 for the purpose of increasing the contact area with the sheet. The sheet P at the portion in contact with the rib 222 deflects along the tip end. Thus, the contact area with the sheet can be practically increased by the tip ends provided with roundness R1. This leads to a reduced pressure for unit area, and hence prevents an image fem being deteriorated by abrasion. Further, the surface is provided with fluorine coating to minimize the frictional drag with respect to the sheet P and to prevent toner or wax from being attached.

The air blown from the outlet 121*a* toward the outlet of the nip section N is repelled by the nip section N outlet and is dispersed to become an exhaust gas flow. The exhaust gas flowing in the vicinity of the lower surface of the blower duct 121 flows away from the outlet of the nip section N, namely, toward the downstream side of sheet conveyance. Thus, the groove 230 constitutes a part of the exhaust gas flow path for the exhaust gas that flows in the vicinity of the lower surface of the blower duct 121.

In the present invention, the sheet P ejected from the nip section N is biased toward the rib 222 by the biasing member located in the vicinity of the nip section N, and is conveyed under the guidance of the rib 222.

In the present invention, the biasing member is made of a plurality of exhaust gas flow paths which are formed of the e aforementioned groove 230 and the sheet P abutting on the rib 222, wherein the exhaust air is discharged to the vicinity of the sheet outlet and is ejected in the sheet conveying direction. The biasing member is intended to bias the sheet P toward the rib 222 by member of the exhaust gas flowing along the exhaust gas flow path.

Figure 10:
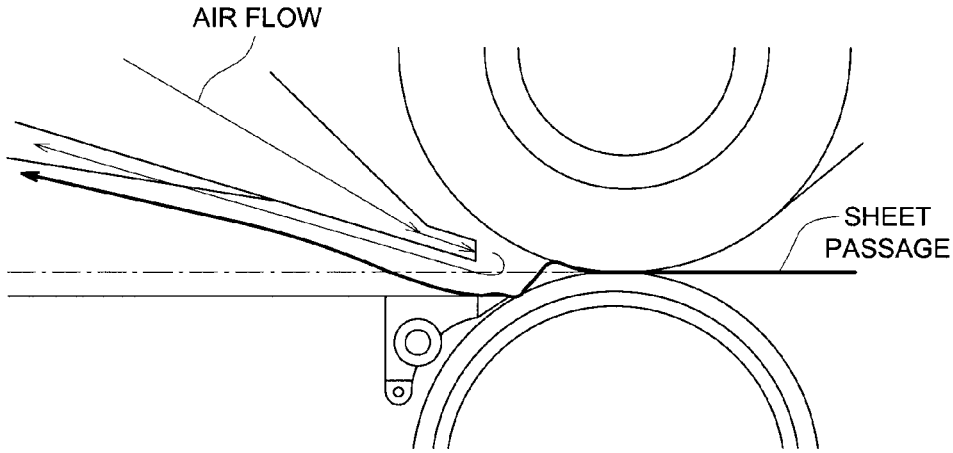
FIG. 10 is a diagram showing the air flow and sheet P conveyance path.

The following describes the biasing by the exhaust gas flow:

FIG. 10 is a diagram showing the air flow and sheet P conveyance path.

The sheet P separated from the pressure miler 84 by the separation claw 86 is separated from the blower duct 121 in the vicinity of the outlet of the nip section N by a turbulent flow or eddy caused by blowing of air.

As sheet ejection proceeds, the sheet P is separated from the fixing belt 8, and starts to be raised from the tip end toward the lower surface of the blower duct 121 under the influence of the flow of air repelled by the nip section N, namely, the exhaust gas flow. When the sheet P has reached the rib 222 of the upper guide plate 221 provided on the lower surface of the blower duct 121, the exhaust gas flows through an exhaust gas flow path provided by the groove 230 which is formed through the rib 222 between the sheet P and blower duct 121 and whose sectional area expands as one goes to the further downstream side. This causes a negative pressure to occur on the side of the exhaust gas flow path, with the result that the sheet P is biased toward the rib 222, namely, guide plate 221.

According to the aforementioned Test 1, if the length of the sheet P ejected from the nip section N (free length) is below a prescribed value, the sheet P is pressed against the sheet ejection guide 85 by air flow. Flapping occurs only when the length has reached a prescribed value. When the toner is cooled before flapping occurs, an image can be prevented from being deteriorated by the abrasion with the guide of the rib 222. This free length was about 150 mm in the present Example.

The following describes the test (Test 2) for determining the angle θ of the rib 222:

<<Test 2>>

Figure 11:
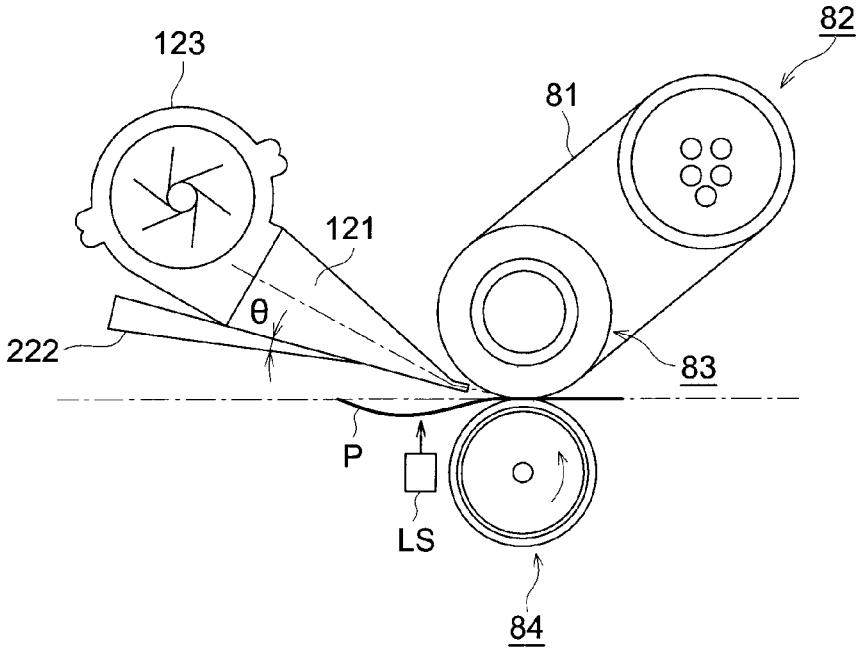
FIG. 11 is a diagram showing the configuration of the equipment used in Test 2.

FIG. 11 is a diagram showing the configuration of the equipment used in Test 2 conducted to verify the effect of forced absorption of the sheet P toward the rib 222 by the negative pressure of exhaust gas flow. Conditions are the same as those in Test 1, except that the lower surface of the blower duct 121 is provided with the upper guide plate 221. The procedure for measuring the flapping is also the same as that of Test 1.

The upper guide plate 221 is arranged at an angle of θ from the position 50 mm away from the outlet 121*a* on the downstream side in the sheet conveying direction, a triangle is formed wherein the length of the rib 222 is 100 mm.

To measure the flapping, the angle θ of the rib 222 was adjusted, and the sheet P was nipped and conveyed by the fixing belt 81 pressure roller 84. Thus, the flapping with respect to each angle θ was measured.

Figure 12:
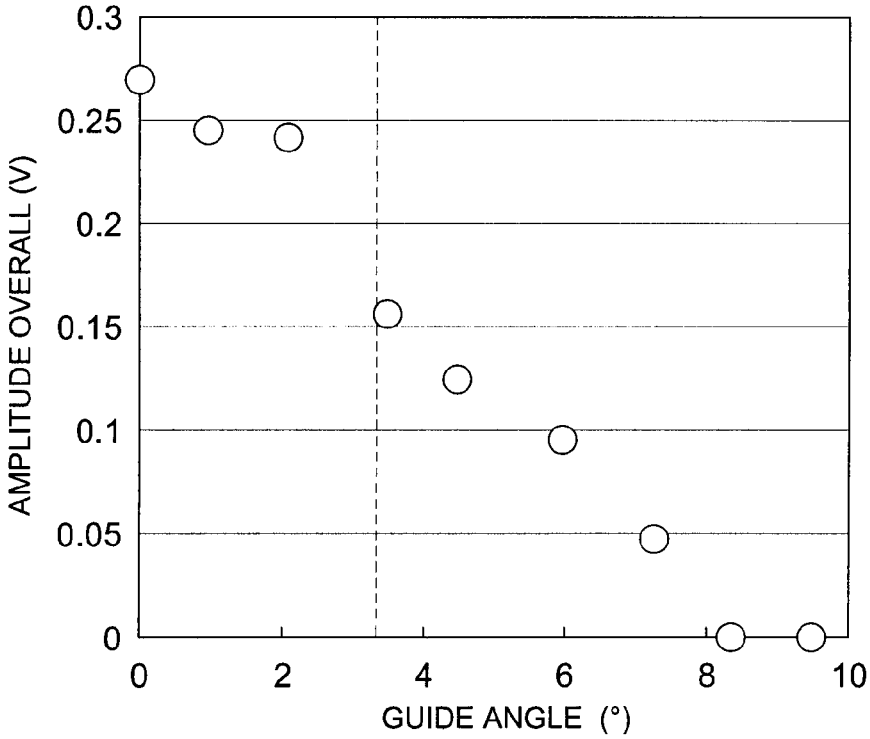
FIG. 12 is a diagram showing the result of Test 2.

FIG. 12 shows the result of the Test 2. When the angle does not exceed 3 degrees, there is a greater impact of the turbulent flow or eddy caused by blowing from the outlet of the nip section N, despite the increased negative pressure. This increases the amount of flapping. If the angle exceeds approximately 3 degrees (toward the angle greater than that indicated by the broken line in FIG. 12), the impact of the turbulent flow or eddy is reduced, with the negative pressure kept intact, to the point wherein the image is not damaged by the flapping. However, if the angle is excessive, the sheet P will be forcibly pressed against the rib 222 because of a high rigidity of the sheet P when thick paper is passed through the machine. This may lead to a heavy abrasion of the sheet P, and hence damage of the sheet P.

Based on the result of Test 2, the angle of the rib is set at 7 degrees in Example 1.

Thus, before the length of the sheet P ejected from the nip section N reaches 150 mm, the sheet P is biased toward the rib 222, and is conveyed under the guidance of the rib 222.

This arrangement ensures the flapping of the sheet P to be reduced. Thus, sheet deformation or paper jam can be prevented, and stable sheet conveyance is provided. Further, image deterioration can be avoided.

EXAMPLE 2

Figure 13:
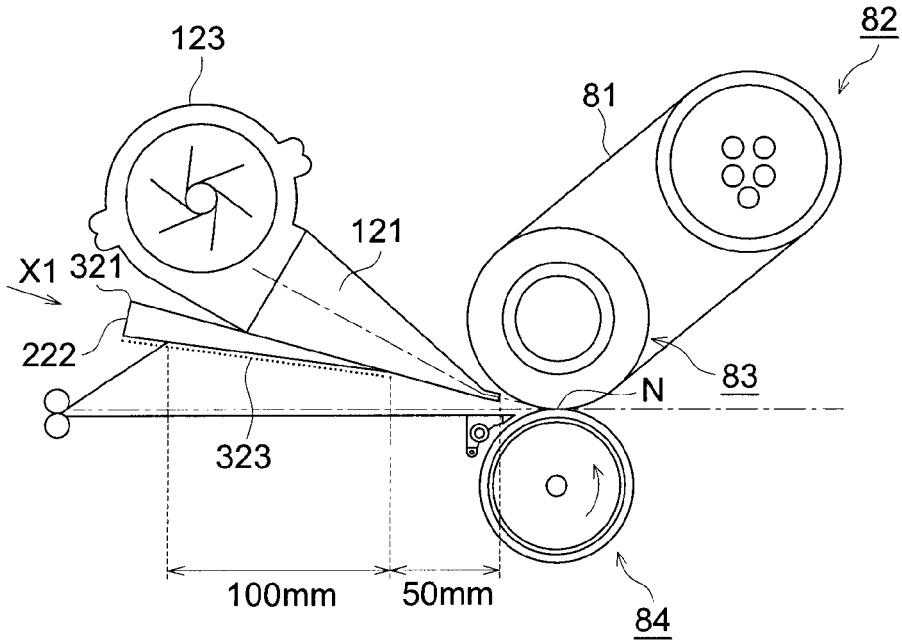
FIG. 13 is a diagram showing an Example 2.
Figure 14:
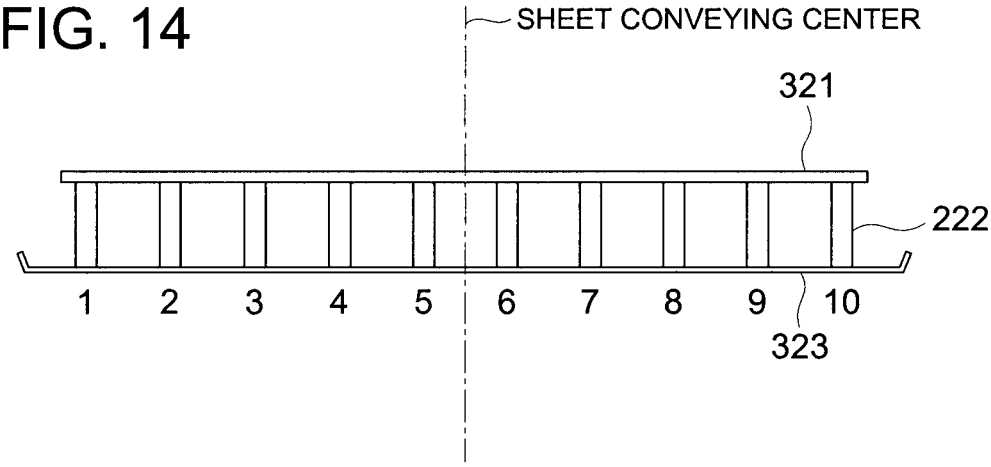
FIG. 14 is a front view as observed from the direction of arrow mark X1 in FIG. 13.

FIG. 13 is a diagram showing an Example 2. FIG. 14 is a front view as observed from the direction of arrow mark X1 in FIG. 13.

Example 2 shows a modified guide device. A wire net 323 is provided on the plane composed of the tip end of the rib 222 of Example 1, whereby an upper guide plate 321 is formed. Otherwise, the specifications are the same as those of Example 1.

The wire net 323 is a member that causes the sheet P to be biased or that guides the sheet P. If the wire net 323 has an excessively small or large mesh, the exhaust gas flow is disturbed. Thus, selection is made not to disturb the exhaust gas flow.

In the Example 2, the wire net 323 uses a stainless steel wire net (a wire diameter of 01 mm with 65 meshes per inch). To minimize the frictional drag with respect to the sheet P and to prevent the toner or wax from adhering, the surface is provided with fluorine coating. Further, in Example 2, the wire net 323 is supported by ribs 222 bearing the numbers 1, 4, 7, 10 in FIG. 14.

In the Example 2, the sheet P is supported by the wire net 323, whereby the number of the contact points us practically increased, and the force for each contact point can be reduced. This arrangement prevents the image from being deteriorated by abrasion.

EXAMPLE 3

Figure 15:
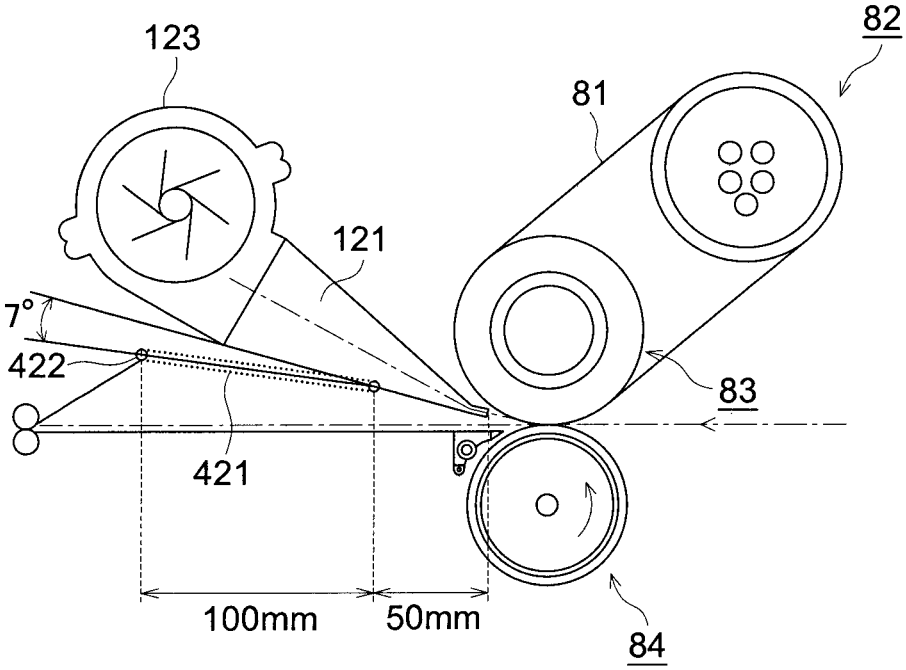
FIG. 15 is a diagram showing an Example 3.

FIG. 15 is a diagram showing an Example 3.

In the Example 3, the endless guide belt 421 which is applied to a plurality of rollers and is rotated by the drive member (not illustrated) as a guide member for biasing the sheet P is arranged on the lower surface of the blower duct 121. Otherwise, the specifications are the same as those of the Example 1.

The guide belt 421 is formed by connecting the ends of the stainless steel wire net (a wire diameter of 0.1 mm with 65 meshes per inch). This Example uses a stainless steel wire net, without the present invention being restricted thereto. For example, a rubber such as an ethylene propylene (EPDM) rubber can be used. Further, the surface is provided with fluorine coating to minimize the frictional drag with respect to the sheet P and to prevent toner or wax from being attached. The belt tension is set at 30 N.

In the Example 3, if the guide belt 421 is kept in contact with one and the same position of the sheet P, an image failure such as uneven gloss will result due to the temperature difference between the contact position and non-contact position. Thus, the speed of the guide belt 421 is kept higher than that of the P, without being equal to that of the sheet P. In this Example, the guide belt 421 is operated at 540 mm per second.

Figure 16:
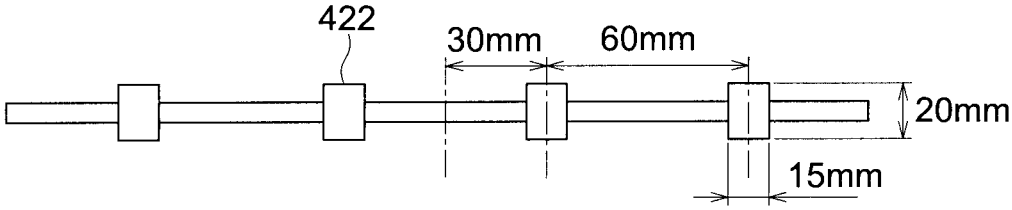
FIG. 16 is a diagram showing the roller of a comb-shaped silicone rubber.

In the roller 422 to which the guide belt 421 is applied, air flow may be disturbed if the all-surface roller is used. Thus, a comb-shaped silicone rubber roller is used, as shown in FIG. 16. This arrangement provides a space for the exhaust gas to flow, and allows a sufficient negative pressure to be produced. This ensures the sheet P to be conveyed while being biased toward the guide belt 421.

For the sheet P wherein the basis weight is up to 80 g/m$^2$ or thereabout, the configurations of the aforementioned Examples 1 and 2 meet requirements without any problem. However, under the conditions wherein the basis weight of the sheet P is further reduced, the sheet P may be pressed against the guide members (rib 222 and wire net 323), and an image failure may occur to the image surface. To cope with such a situation, the Example 3 provides more effective solution.

EXAMPLE 4

Figure 17:
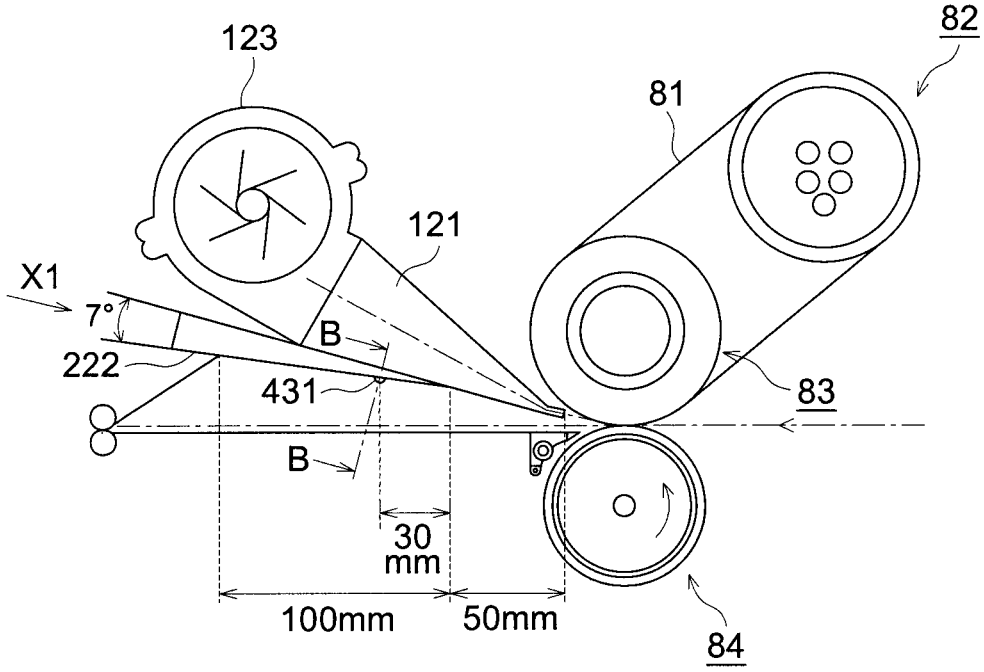
FIG. 17 is a diagram showing an Example 4.
Figure 18A:
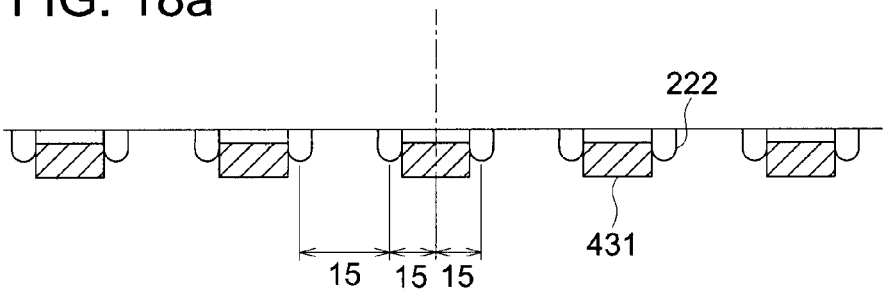
FIGS. 18*a* and 18*b* are front view as observed from the direction of arrow mark X1 in FIG. 17.

FIG. 17 is a diagram showing an Example 4. FIG. 18 is a front view as observed from the direction of arrow mark X1 in FIG. 17. FIG. 18*a* indicates the cross section BB.

In the Example 4 as in the Example 1, ribs 222 are provided, and a rotatably supported roller 431 is provided on the ribs 222 80 mm away from the outlet 121*a*.

Figure 18B:
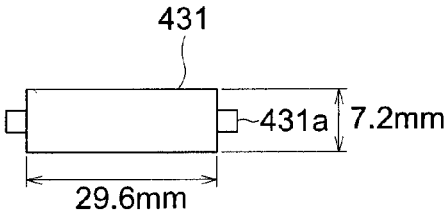

As shown in FIG. 18*a*, one roller 431 is installed at the center, and then others are placed at intervals. A total of five rollers are installed. FIG. 18*b* shows an example of the configuration of the roller 431. A surface layer characterized by excellent release characteristics is formed on the surface of the roller 431. In the present Example, the substrate uses the SUS 303, and the surface layer is provided with bead coating (MRG 1090 by Mizoguchi Kogyo Co., Ltd.).

Figure 19:
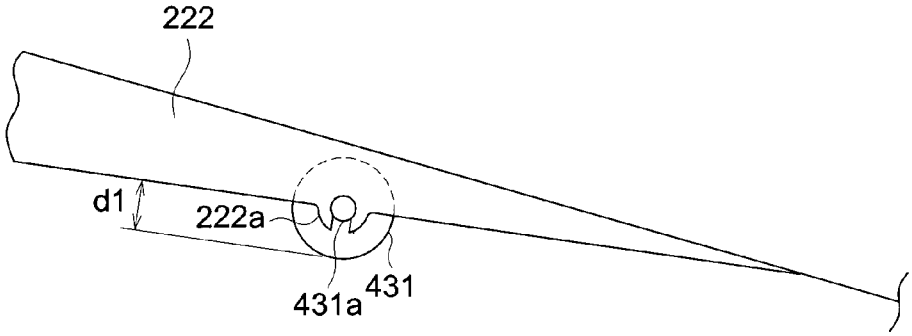
FIG. 19 is an enlarged view showing the layout along the height of the roller 431.

FIG. 19 is an enlarged view showing the layout along the height of the roller 431. The roller 431 is installed so that the center thereof will be flush with the plane formed by the tip end of the rib 222. Namely, the roller is installed in such a way that the dimension d1 of FIG. 19 will be half the diameter of the roller 431. In the present Example, d1=3.6 mm.

The roller 431 is supported by inserting the shaft 431*a* of the roller 431 into the roller supporting section 222*a* provided on the rib 222. It should be noted that the method of supporting the roller 431 and dimension d1 are not restricted to the aforementioned examples.

This roller 431 ensures smooth conveyance of the recording sheet and prevents the image from being deteriorated by abrasion of the guide. Further, similarly to the case of Example 3, greater efficiency is provided when the basis weight of the sheet P is further reduced from 80 g/m$^2$.

EXAMPLE 5

Figure 21:
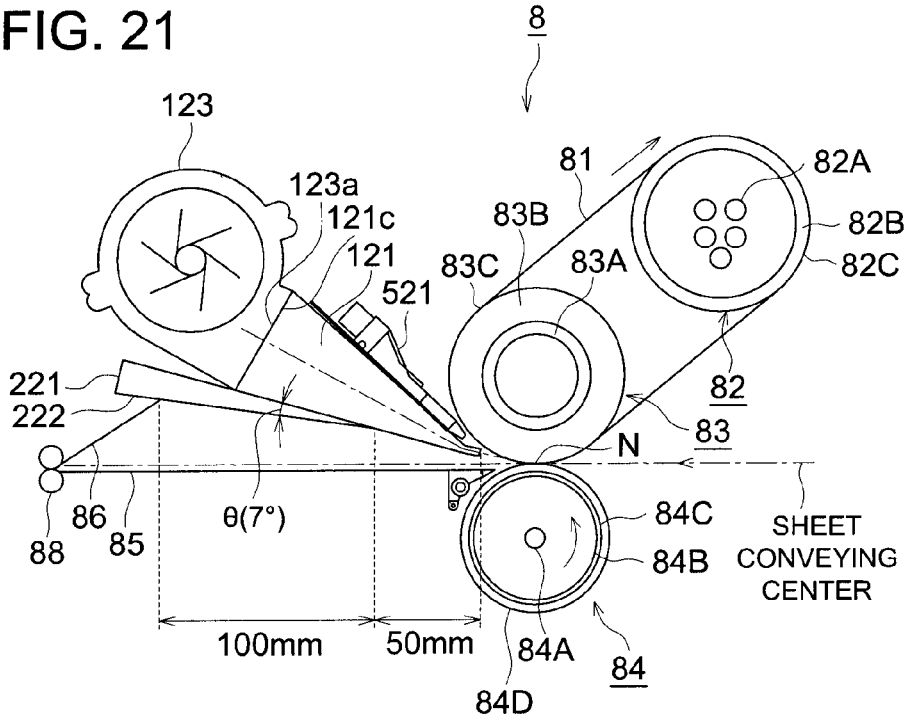
FIG. 21 is a diagram showing an Example 5.

FIG. 21 is a diagram showing an Example 5.

In the present Example, the separation member includes a first separation member made up of a fan 123 and blower duct 121 and a second separation member made up of compressor (not illustrated), a solenoid valve (not illustrated), a blower tube (not illustrated) and nozzle 521. The first separation member has the same configuration as that of the Example 1. Namely, the Example 5 consists of the configuration of Example 1, plus the second separation member.

The nozzle 521 of the second separation member is installed between the blower duct 121 and fixing belt 81, and blows air to the vicinity where the sheet separation is installed.

The following describes the details of the compressor, solenoid valve and nozzle:

Compressor: 0.75 kW, 0.8 MPa, 0.00125 m$^3$/s (reciprocation type/oil free), accumulator tank capacity; 0.05 m$^3$ Direct acting type solenoid valve: capacity 0.001 m$^3$/s (100 kPa), response speed: up to 20 ms; quantity: 2

Separation assisting nozzle: nozzle diameter 0.8 mm, quantity 130 (2.5 mm pitch)

Nozzle blow outlet position: 25 mm from the outlet of the nip section N

The configurations of the upper guide plate 221 as a guide device and the separation claw 86 are the same as those of Example 1.

In the image forming operation, the sheet P is fed out of the registration miler 23 (FIG. 1). At the same time, power is supplied to the fan 123, and air is blown from the blower duct 121 to assist separation of the sheet P. To put it another way, air starts to come out of the first separation member.

Synchronously with the leading edge of the sheet P being ejected from the nip section N, the operation of the second separation member starts. Air is blown from the nozzle 521 to separate the leading edge of the sheet P from the fixing belt 81. In the present Example, the second separation member of higher air pressure is used to separate the leading edge of the sheet P characterized by greater power of adsorption to the fixing belt 81. In the meantime, after the leading edge of the sheet P has been separated, the first separation member of smaller air pressure is utilized. This technique ensures positive separation of the sheet P and allows the fixing performance and sheet conveying performance to be maintained without being deteriorated.

In the present Example, flapping occurs when the second separation member is stopped and air is blown only by the first separation member. This provides the same effect as that of Example 1, using the same configuration as that of Example 1.

What is claimed is:

1. A fixing device conveying a sheet carrying a toner image under heating and pressurization at a nip section and fixing the toner image on the sheet comprising:

a fixing member provided with a heating member;

a pressure member pressing on the fixing member and forming the nip section which sandwiches the sheet carrying the toner image;

a blower duct equipped with an outlet opening toward a vicinity of a sheet outlet of the nip section;

a blower member for blowing air in a vicinity of the sheet outlet through the blower duct; and a guide device provided with a guide member for guiding the sheet ejected from the nip section arranged on an upper side of a sheet conveyance path, wherein an exhaust gas flow moving along an exhaust gas flow path formed through the guide device between the blower duct and the sheet biases the sheet toward the guide member.

2. The fixing device of claim 1 wherein a sectional area of the exhaust gas flow path is increased in size in a direction in which the exhaust gas flow moves.

3. The fixing device of claim 1 wherein the guide device is configured to comprise a rib.

4. The fixing device of claim 1 wherein the guide device is configured to comprise a net.

5. The fixing device of claim 1 wherein the guide device is configured to comprise a belt.

6. The fixing device of claim 1 further comprising;

a separation claw arranged on a lower side of the sheet conveyance path to separate the sheet from the pressure member.

7. An image forming apparatus comprising the fixing device of claim 1.

* * * * *